US005150986A

United States Patent [19]

Rohr

[11] Patent Number: 5,150,986

[45] Date of Patent: Sep. 29, 1992

[54] PROCESS AND APPARATUS FOR DEPOSITING SILT ON THE BOTTOM AND SLOPES OF THE WET OPEN WORKING OR DREDGING

[76] Inventor: Wolfgang Rohr, Speyerer Str. 74-80, 6701 Otterstadt, Fed. Rep. of Germany

[21] Appl. No.: 642,348

[22] Filed: Jan. 17, 1991

[30] Foreign Application Priority Data

Jan. 20, 1990 [DE] Fed. Rep. of Germany ..... 4001630

[51] Int. Cl.[5] ..... E02F 5/22

[52] U.S. Cl. ..... 405/223; 405/55; 405/74; 37/195

[58] Field of Search ..... 37/195; 299/9; 405/17, 405/52, 73, 74, 129, 195, 222, 223, 15, 53, 55, 303

[56] References Cited

U.S. PATENT DOCUMENTS 2,880,981 4/1959 Berestrom ..... 299/9 X
3,161,438 12/1964 Novak ..... 299/9
3,731,975 5/1973 Lindelof ..... 37/195 X
4,397,587 8/1983 Op den Velde et al. ..... 405/22
4,896,445 1/1990 Deal ..... 37/195

FOREIGN PATENT DOCUMENTS 665961 9/1929 France ..... 37/195
51512 3/1988 Japan ..... 405/223

*Primary Examiner*—Randolph A. Reese
*Assistant Examiner*—John Ricci
*Attorney, Agent, or Firm*—Kinzer, Plyer, Dorn McEachran & Jambor

[57] ABSTRACT

Sand and gravel material conveyed from a floating dredger is fed to a treatment installation where silt is separated. The silt arising in the process may be fed over a floating pipe line and swingable pipe so arranged as to feed silt to an under-water diffuser which deposits the material for sealing-off on the lake bottom or its side. The diffuser may be arranged by a floating station.

3 Claims, 8 Drawing Sheets

Figure 1:
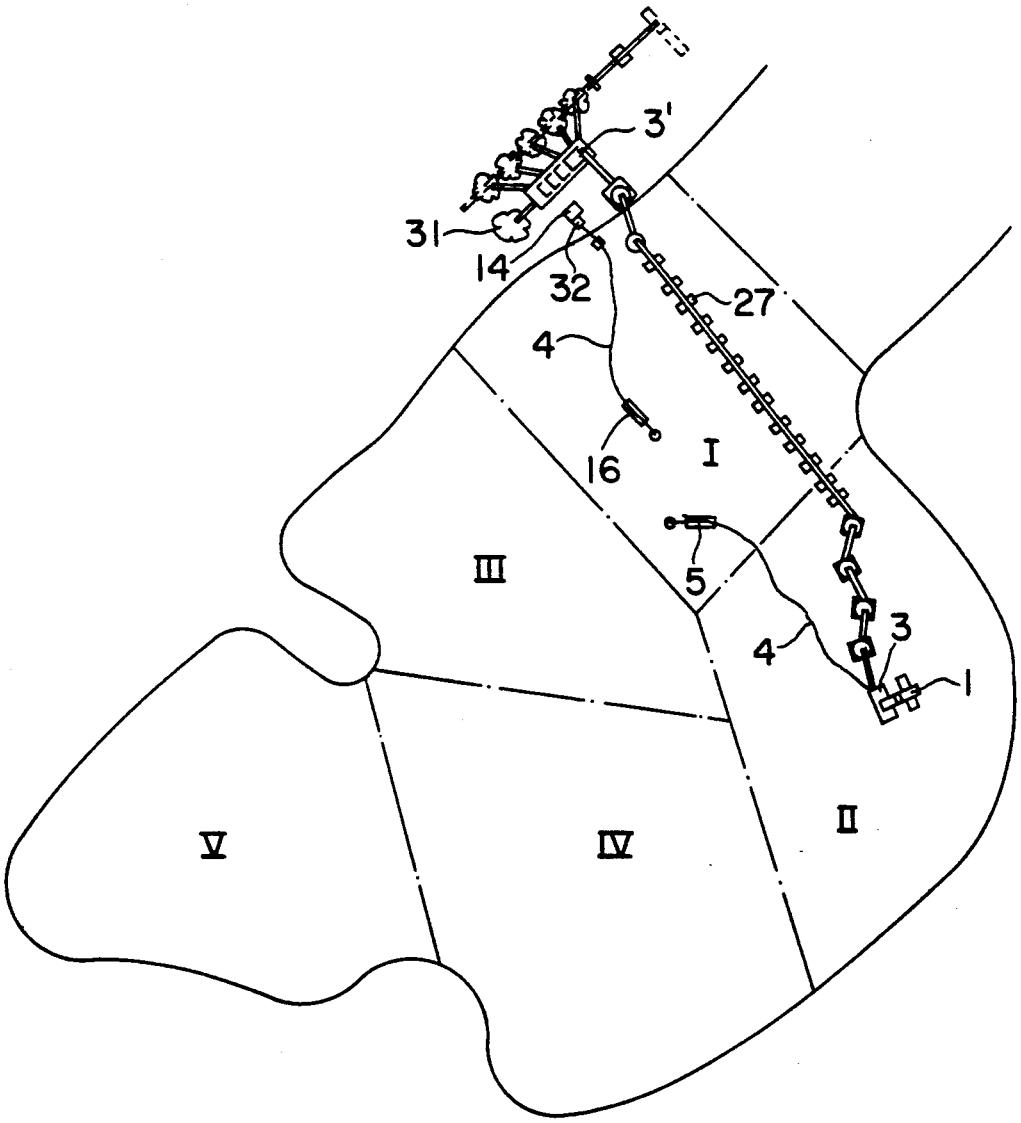

PROCESS AND APPARATUS FOR DEPOSITING SILT ON THE BOTTOM AND SLOPES OF THE WET OPEN WORKING OR DREDGING

The invention relates to a process for depositing silt on the bottom and slopes of the wet open working, in which the silt (finest material) is brought or transported in common with the recovered sand and gravel material to a treatment installation, separated there from the usable material and then deposited on the bottom and slopes of the borrow pit of the wet open working.

Before such a depth dredging and lake seal-off is undertaken it is required that a landscape ecological statement of expert opinion be drawn up concerning the borrow pit, which is to cover the following areas: A state survey in regard to the vegetation and land utilization, the animal world, the protected zones and zones to be spared according to protection of nature and water rights, planning intention and public interests. Further, suitably qualified drillings are to be carried out for the appraisal of the occurrence of raw material. The results of the drillings are to be assessed. For the lake seal-off of especial importance is, in particular, the determination of the amount and composition of the silt constituents of the subground. On the basis of the appraisal of the silts accumulating there is to be drawn up a soil mechanical statement of expert opinion, which prescribes, in particular, the minimum thickness of the sealing layer in the case of the permeability coefficient found of the sealing material. Accompanying the soil mechanical expert opinion there is to be submitted a statement of expert opinion in regard to the possible or requisite inclinations of the slopes in order to assure their stability. Deriving from the results of a landscape ecological assessment there is to be made a statement as to the extent to which the flow or renewal of the water in the sealed-off zone of the lake is assured. In this context there are to be heeded especially the experiences of the competent water-economy service offices inclusive of the regional offices for the environment.

Further, the dredging-produced lakes that have resulted from the taking of sand and gravel are to be developed insofar as possible as moisture biotopes. For the biotopes there are to be developed in each case correspondingly formed shallow-water zones. In the region of the flow-through of the sea, they lie as a rule above the lake seal-off in the upper ground water introducer or drainage.

Sand and gravel working under water is executed as follows. The top soil or cover layers in the native soil and the rubble are removed and reused according to process established in the plan. For great depths there are used floating grabs and compressed air dredgers and for lesser depths bucket chain dredgers, suction dredgers and scrapers.

The recovered sand and gravel material is brought over conveyor belts, over pipeline transport or ship transport to a treatment installation located on land. This installation processes sand and gravel in accordance with the valid regulations or standards for concrete additives, road-building materials and the like. The treatment occurs, as a rule, with water. Unusable material, such as silt, extremely fine sand of less than 100$\mu$, are returned to the working area. The gravel processing installations are often arranged also directly on the dredgers. The silt and sludge substances, therefore, namely from the zone of the treatment installation, are brought back into the dredging-produced lake. This return of the extremely fine substances takes place uncontrolled.

Underlying the invention is the problem of proposing a process and an apparatus with which the depositing of the silt under water is controllable, in order to seal off the bottom and slope of the open working and therewith to separate the ground water system from the water of the ground water conductor or water shed surrounding it.

This problem is solved according to the invention by the means that separated silt is completely taken up (recovered), pumped over a flexible conveyor line to an exactly determined place of the bottom and/or slope of the wet open working, which is regularly shifted or changed, and there brought up (deposited) in a determined amount as a discharge.

An advantageous process step provides that the sludgeable (silt) substances are pumped to an underwater diffusor and deposited.

A further process step provides that silt or rubbish fill interstored on land is pumped with addition of water to the diffusor system.

An advantageous apparatus for the depositing of silt on the bottom and/or slope of the wet open working according to the process, comprising a recovery apparatus, a treatment installation for the sand and gravel mixture with an arrangement for the separating-out of the water-and-silt mixture, consists in that the arrangement for the separating-out of the water-and-silt mixture is communicated by a pump and a pipe line with at least one underwater diffusor which is fastened to a floating station and, in order to deposit the silt directly on the bottom and/or the slope, is directed with its opening upon the bottom or the slope.

A further advantageous form of execution provides that on the floating body of the floating station there are anchored the floating pipe line and the diffusor, the pipe line being arranged on a swingable outrigger system with hoist.

It is advantageous that the diffusor is connected or supported on a swingable pipe of the outrigger system.

Further it is proposed that the silts are collectable in a basin which is connected with the diffusor by means of of a line laid partly on land and partly floating.

Further it is advantageous that a diffusor is connected over lines simultaneously with the basin and the floating processing installation.

It is advantageous that a second diffusor is connected to the treatment installation.

It is proposed, finally, that the diffusor is connected in the manner of a plate connecting to its conical part, there being provided air inlet and air outlet guides laterally above a friction plate.

The invention offers the substantial advantage that over a controlled sealing, new raw material reserves can be opened up without endangering the protection of the ground water. Quite the contrary, the protection of the ground water is substantially improved over the conventional working methods and the use of the dredger area is minimized. With smaller and deeper water areas the often addressed problem of the water evaporation is restricted to a minimum.

Furthermore it is achieved that the ground water horizons reserved for the drinking water recovery can be protected from contamination, as the sand and gravel borrow pits are sealed off.

The invention is explained in detail in the following specification with the aid of examples of execution represented in the drawings.

Figure 2:
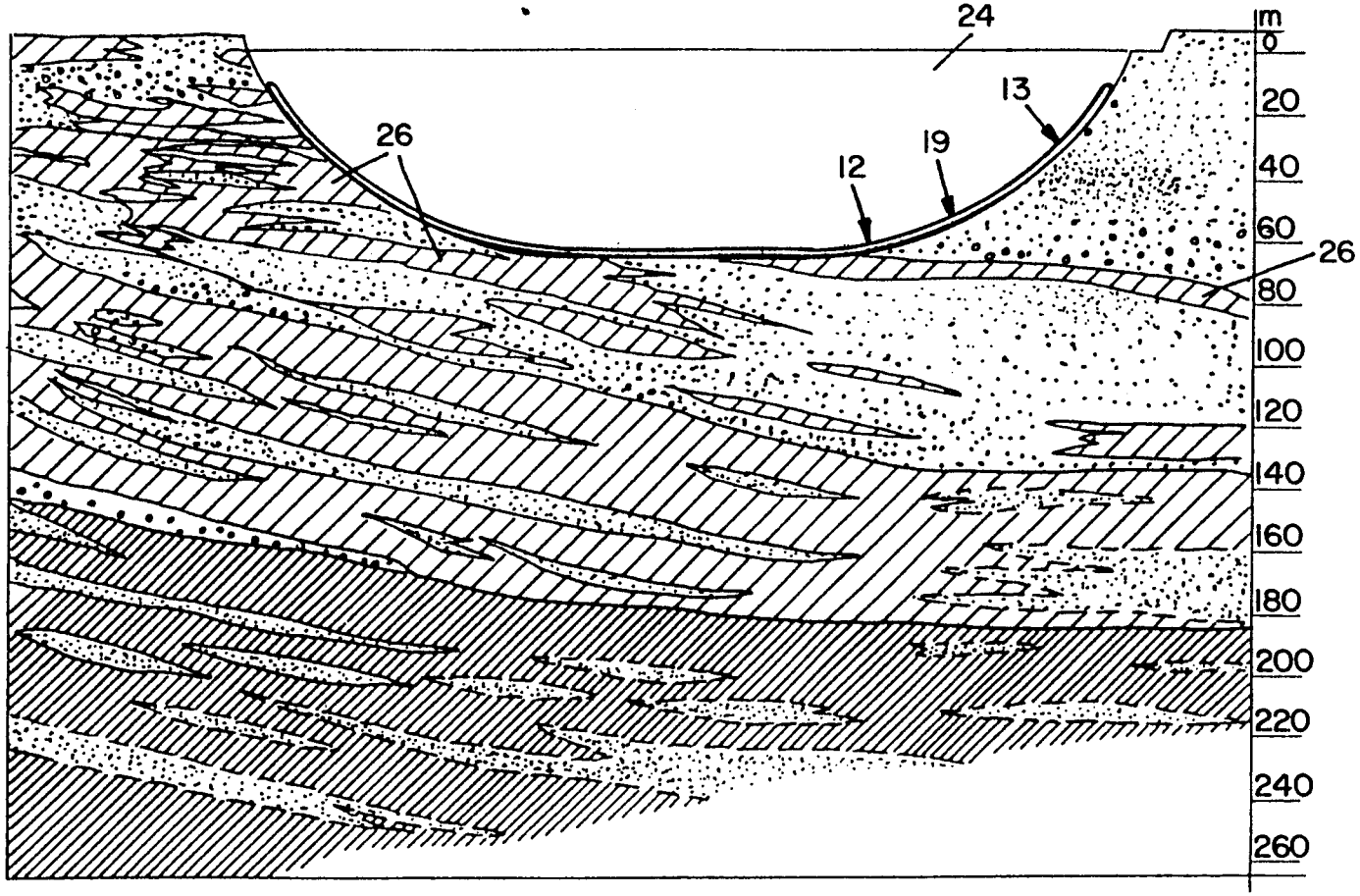
Figure 3:
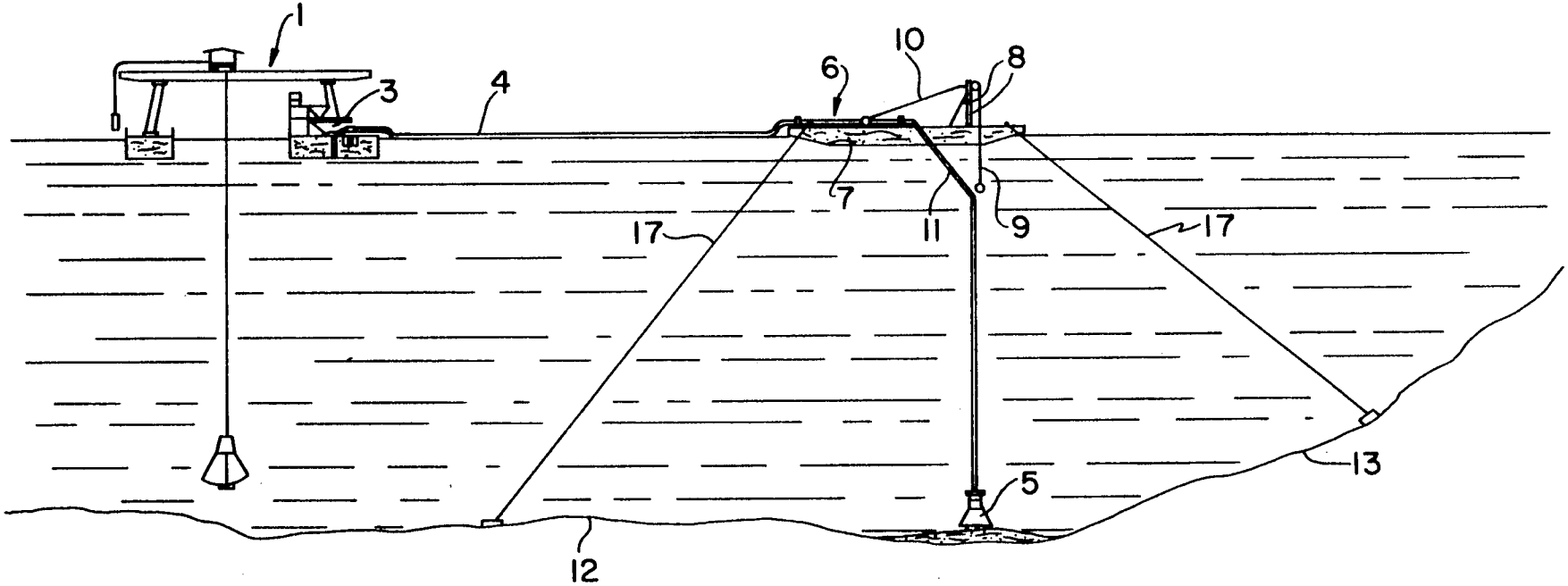
Figure 4:
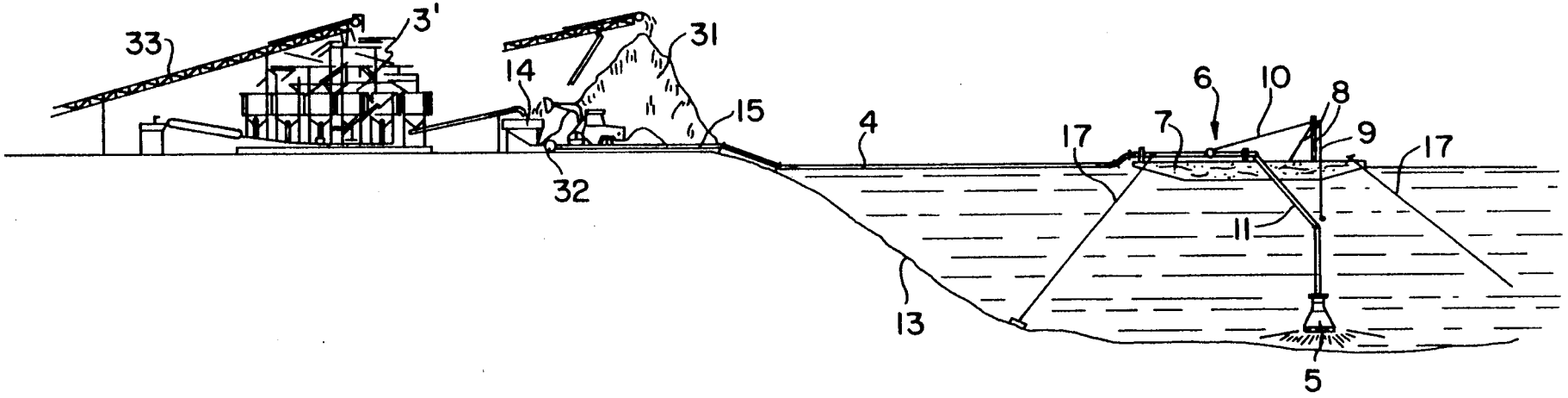
Figure 5:
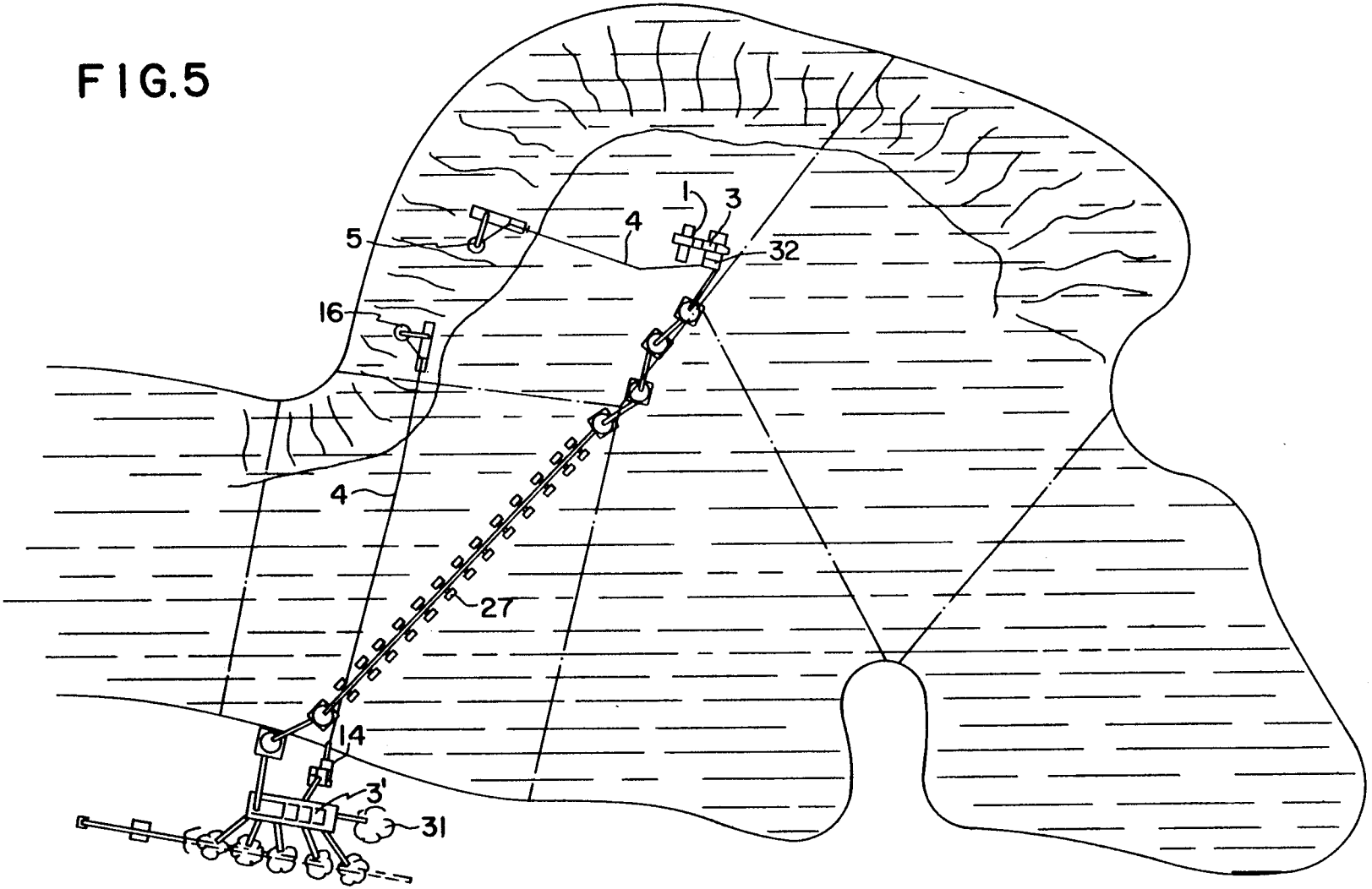
Figure 6:
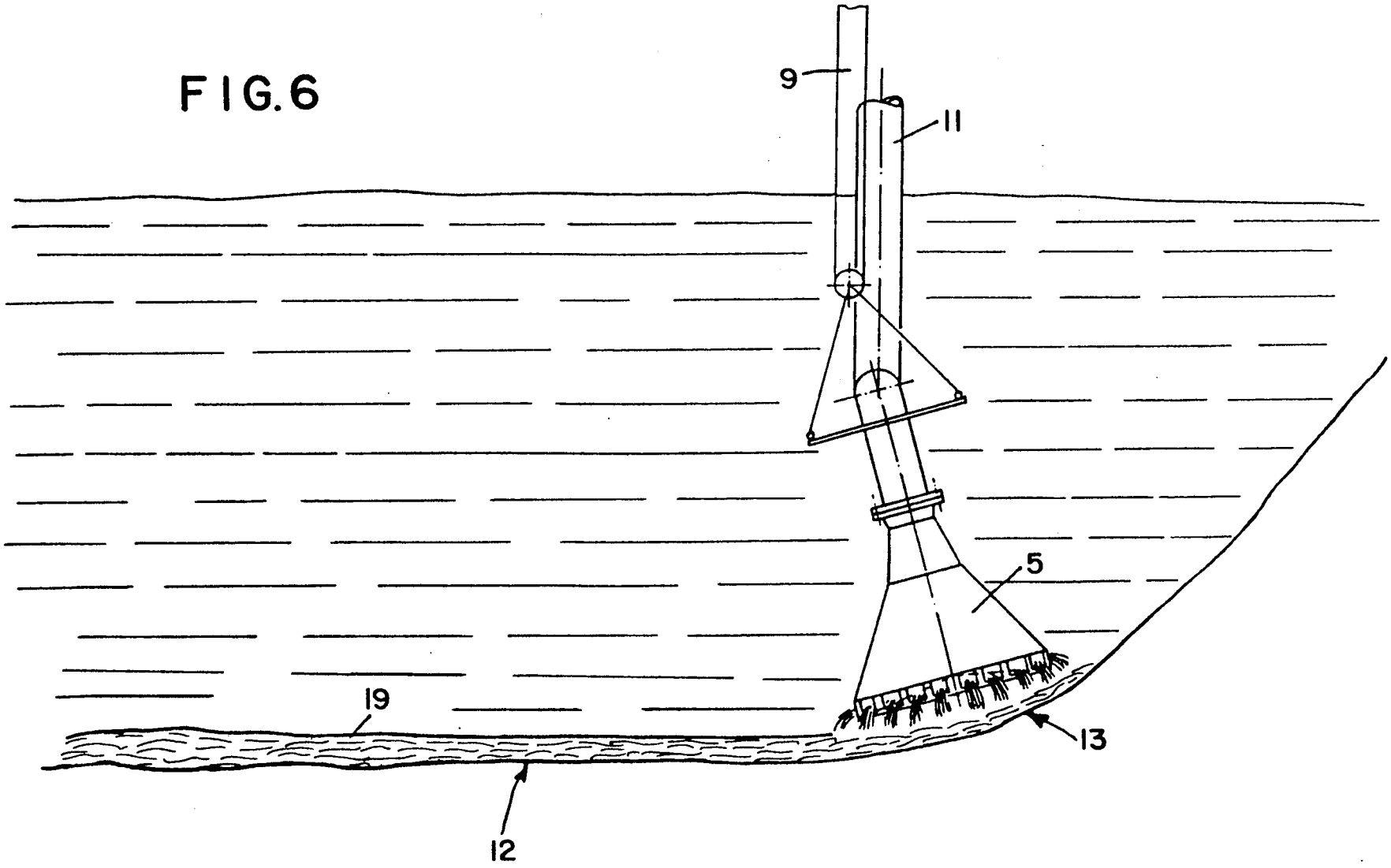
Figure 7:
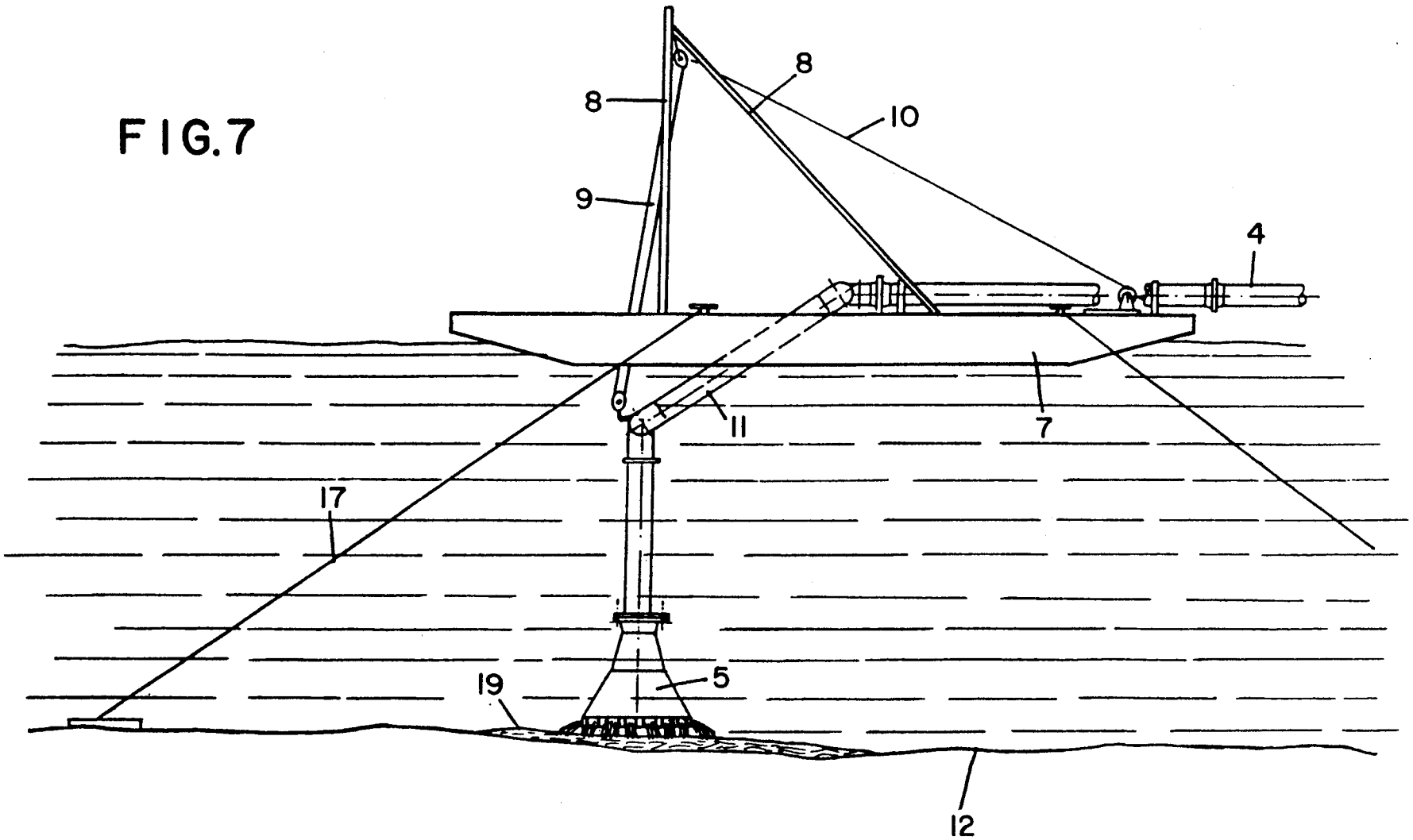
Figure 8:
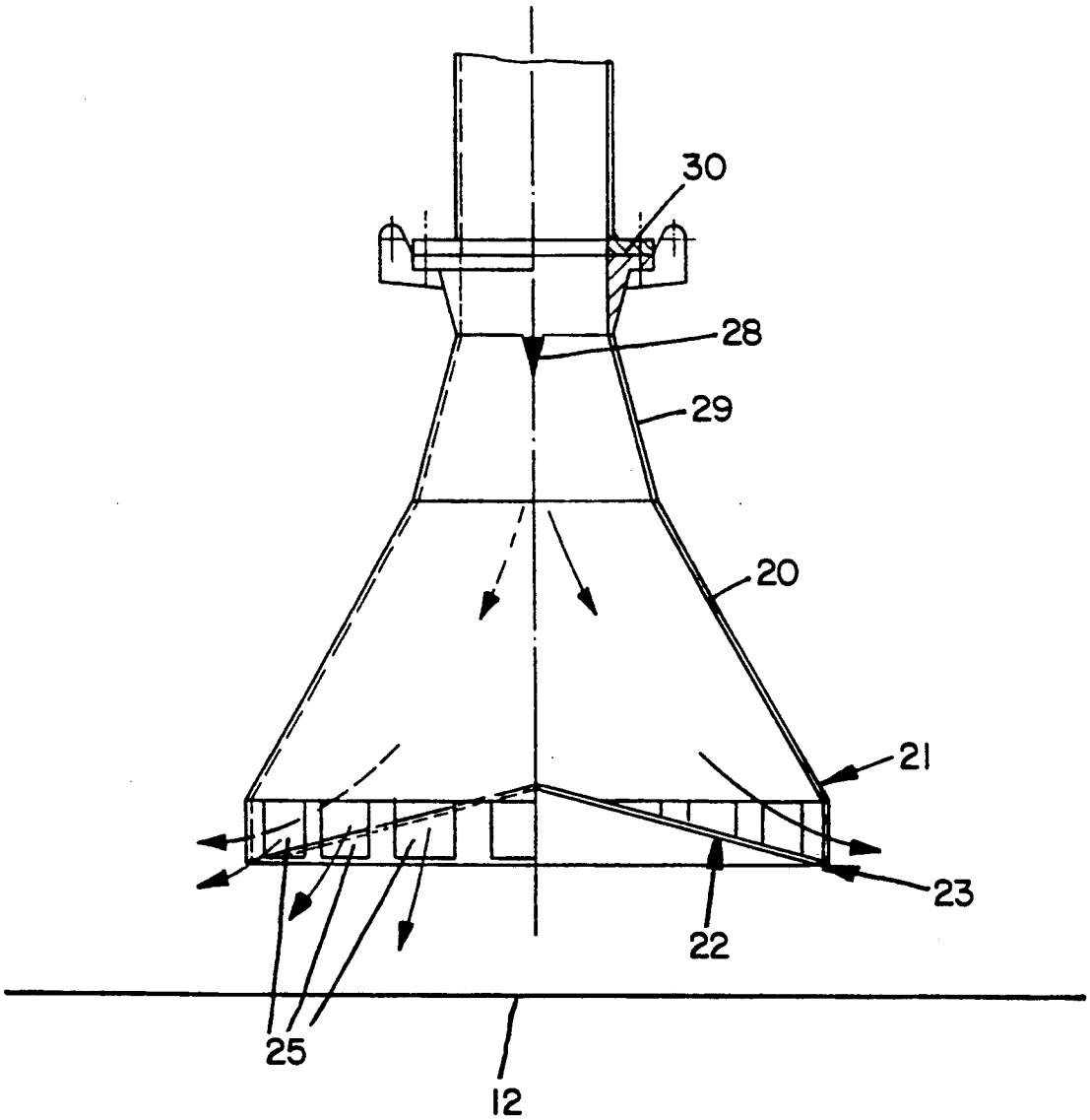

FIG. 1 shows a view of a gravel working plan,

FIG. 2 a hydrogeological section of a gravel working place,

FIG. 3 a floating grab with a device for sealing off the bottom of a dredging-produced lake, FIG. 4 an apparatus of this type with pump and collecting basin arranged on land for the silts and connection of deposited silts, FIG. 5 a plan view of such a dredging-produced lake two devices for the sealing off of the bottom and of the slope, FIG. 6 an elevation view of the dredging-produced lake in the sealing off of the slope, FIG. 7 the device for the sealing off of the bottom in an enlarged view and FIG. 8 a diffusor usable for the sealing off.

FIG. 1 shows the plan view of a dredging-produced lake according to a working plan, in which the dredging-produced lake is subdivided into five working sections I to V. After working section I is dredged out, it is sealed off according to the process of the invention. In the drawing there is represented the dredger 1 with treatment installation 3, which is connected with the land over conveyor belts 27. On the land there is further provided a treatment installation 3', to which there is allocated a deposit 31, where rubbish and silts are collected. Beside this installation 3' there is further provided a collecting container or basin 14, to which there is connected a further floating line 4 to a further diffusor 16. Over this basin 14 with pump 32 the finest parts are pumped to the diffusor 16.

FIG. 2 shows the hydrogeological section of such a gravel working place and the lake 24 that has arisen there. The lake bottom 12 and the slopes 13 are provided (formed), as sealing deposit, with a layer of extremely fine substances 19. In this representation the individual clay strata are well recognizable and are shaded, in which system through the dredging-out there still remain individual clay lenses or strata 26.

In the form of execution represented in FIG. 3, by means of a floating dredger 1 with a grab 2 lowered to the bottom sand and gravel material is conveyed. This material is processed in a treatment installation 3 arranged on the dredge 1, in accordance with regulations. The silts here arising are pumped over a floating pipe line 4 to an underwater diffusor 5, which is arranged on a floating station 6. The floating station 6 has a float body 7 on which there is arranged a swingable outrigger system 8, 9. The outrigger system 8, 9 is provided, further, with a hoist 10. Further, the floating pipe line 4 is anchored on the floating body 7, in which arrangement a swingable pipe 11 connects, which is joined with the diffusor 5. The diffusor 5 has the function of distributing the silt material coming from the pumps on the lake bottom 12 without appreciable clouding of the water, as the flow rate is reduced and the material is concentrated. Further, the execution of the diffusor 5 is to be chosen in such a way that the finest sludges are concentrated and are deposited expanded on the lake bottom 12 of the slope 3. The depositing of the stratum thickness can be automatically controlled and monitored.

The entire underwater diffusor system, after reaching of the necessary stratum thickness, can be shifted over capstans. This process, too, can be automated.

After the layer thickness of the sealing is established, with a corresponding working advance (FIG. 1) the sealing material is to be brought in; first with a recovery apparatus a final depth is created, then with the further progressing working the lake bottom 12 or the slope 13 is sealed off with the system. Up to the achieving of the final depth also the silt material can be deposited on land in drainage basins or containers 14 (FIGS. 1 and 4) (deposit 31) in order then to be available for a later sealing-off. As FIG. 4 shows, the gravel with the silts comes over a conveyor belt 33 from the dredger 1 to the gravel treatment installation 3'. Likewise suitable working material can be fed to the collecting basin 14 with simultaneous addition of water over the pump 32 to the diffusor 5.

The connecting of the floating station 6 occurs here over a section of a pipe line 15 laid on land, which then goes over into the floating pipe line 4.

The process described is suited also for the deepening of the already present dredging-produced lakes.

In the plan view shown in FIG. 5, there is also used a second underwater diffusor 16, which is used according to the working plan. This diffusor 16 is connected over a floating line 4 with collecting basins 14 arranged on land. It is also possible to charge a diffusor 5 or 16 over both lines 4.

In FIG. 6 it is shown how the diffusor 5 deposits the washable components on the lake bottom 12 and on the slope 13. The grain size of these finest substances lies under 100μ, for example on an order of magnitude between 0 and 0.063 mm.

FIG. 7 shows the form of execution of such a floating station 6. This floating station 6 is fastened to the lake bottom 12 with the aid of an anchor 17. Here, the sludge layer 19 is deposited by the diffusor 5.

One possible form of execution for the diffusor 5 or 16 is presented in FIG. 8. The diffusor has a conical part 20 which expands toward the bottom 12 and terminates in a disk or a plate-form section 21. The bottom of the diffusor has a friction or abrasion plate 22 sloping from the center toward both sides, which is constructed on its edge as a bounce plate 23. Over discharge openings 25 the silt material is discharged with low turbulence. The sludge inflow occurs in arrow direction 28. At the upper end of the conical pipe 29 there is present a screw-on flange 30.

I claim:

1. Process for depositing silt on the bottom and the slopes of a wet open landscape working having a borrow pit, in which silt material in common with recovered sand and gravel material taken from the borrow pit is transported to a treatment installation, separated there from usable material and then deposited as sealing silt on the bottom and the slopes of the borrow pit of the wet open working, characterized in that separated out silt is recovered, pumped over a flexible conveyance line to a floating discharge station supporting an underwater silt depositing system at an exactly determined place of the bottom and/or slope of the wet open working, which place is regularly shifted, and deposited there as a sealing discharge in a determined stratum thickness, and shifting the depositing system after reaching a stratum thickness.

2. Process according to claim 1, characterized in that the silt is pumped to and deposited by an under-water diffusor supported by a swingable outrigger at the discharge station.

3. Process according to claims 1 or 2 characterized by the additional steps of storing on land silt taken from the borrow pit and pumping the stored silt to the floating discharge station for deposit as a sealing discharge.

* * * * *